US009240271B2

(12) United States Patent
Liang

(10) Patent No.: US 9,240,271 B2
(45) Date of Patent: Jan. 19, 2016

(54) INDUCTOR THAT SWITCHES BETWEEN COUPLED AND DECOUPLED STATES

(75) Inventor: Xiaoguo Liang, Pudong Shanghai (CN)

(73) Assignee: Intel Corporation, Santa Clara, CA (US)

( * ) Notice: Subject to any disclaimer, the term of this patent is extended or adjusted under 35 U.S.C. 154(b) by 131 days.

(21) Appl. No.: 14/006,400

(22) PCT Filed: Sep. 30, 2011

(86) PCT No.: PCT/CN2011/001659
§ 371 (c)(1),
(2), (4) Date: Sep. 20, 2013

(87) PCT Pub. No.: WO2013/044416
PCT Pub. Date: Apr. 4, 2013

(65) Prior Publication Data
US 2014/0015508 A1 Jan. 16, 2014

(51) Int. Cl.
*G05F 1/32* (2006.01)
*H01F 27/00* (2006.01)
*H01F 21/00* (2006.01)

(52) U.S. Cl.
CPC ..... *H01F 27/00* (2013.01); *H01F 21/00* (2013.01)

(58) Field of Classification Search
CPC ..... H01F 2029/143; H01F 29/14; G05F 1/02; G05F 1/32; G05F 1/34
USPC ..... 323/250, 251, 328, 331, 334; 363/91
See application file for complete search history.

(56) References Cited

U.S. PATENT DOCUMENTS

| | | | | |
|---|---|---|---|---|
| 4,491,816 | A | 1/1985 | Blum | |
| 4,620,144 | A | 10/1986 | Bolduc | |
| 4,652,776 | A | 3/1987 | George | |
| 5,497,310 | A | 3/1996 | Noda et al. | |
| 6,200,102 | B1 * | 3/2001 | Diaz | 417/50 |
| 2004/0150500 | A1 * | 8/2004 | Kiko | 336/90 |

FOREIGN PATENT DOCUMENTS

| | | | |
|---|---|---|---|
| CN | 86100229 | A | 7/1986 |
| CN | 101056050 | A | 10/2007 |

(Continued)

OTHER PUBLICATIONS

International Search Report dated Jul. 5, 2012 for corresponding Application No. PCT/CN2011/001659.
International Preliminary Report on Patentability and Written Opinion received for PCT Patent Application No. PCT/CN2011/001659, mailed on Apr. 10, 2014, 6 pages.

(Continued)

*Primary Examiner* — Adolf Berhane
(74) *Attorney, Agent, or Firm* — KED & Associates LLP

(57) ABSTRACT

An apparatus includes first core spaced from a second core. The second core has a first section with a first winding, a second section with a second winding, and a third section between the first and second sections. At least one filler is included between the first core and the third section of the second core. The operational state of the apparatus changes based on the amount of magnetic flux through the filler. When the flux is at an unsaturated level, the first and second windings operate as decoupled inductors. When the flux is at a saturated level, the first and second windings operate as a coupled inductor. The amount of magnetic flux through the filler may be determined based on the size of the current through one or more of the windings and/or the magnetic permeability of the filler material.

30 Claims, 8 Drawing Sheets

(56) References Cited

FOREIGN PATENT DOCUMENTS

| | | | |
|---|---|---|---|
| JP | 2009-224439 | A | 10/2009 |
| WO | 2013/044416 | A1 | 4/2013 |

OTHER PUBLICATIONS

Office Action received for Chinese Patent Application No. 201180073775.6, mailed on Sep. 29,2014, 16 pages of English Translation and 9 pages of Office Action.

* cited by examiner

INDUCTOR THAT SWITCHES BETWEEN COUPLED AND DECOUPLED STATES

FIELD

One or more embodiments described herein relate to voltage/current control.

BACKGROUND

Voltage regulation continues to be an area of interest in circuit design, especially for purposes of preventing unnecessary consumption of power. While all systems can benefit from improvements in voltage regulation, battery-powered devices are a special focus. Promoting efficient management of battery power usage will translate into improved performance, giving users enhanced capability.

DETAILED DESCRIPTION

Figure 1:
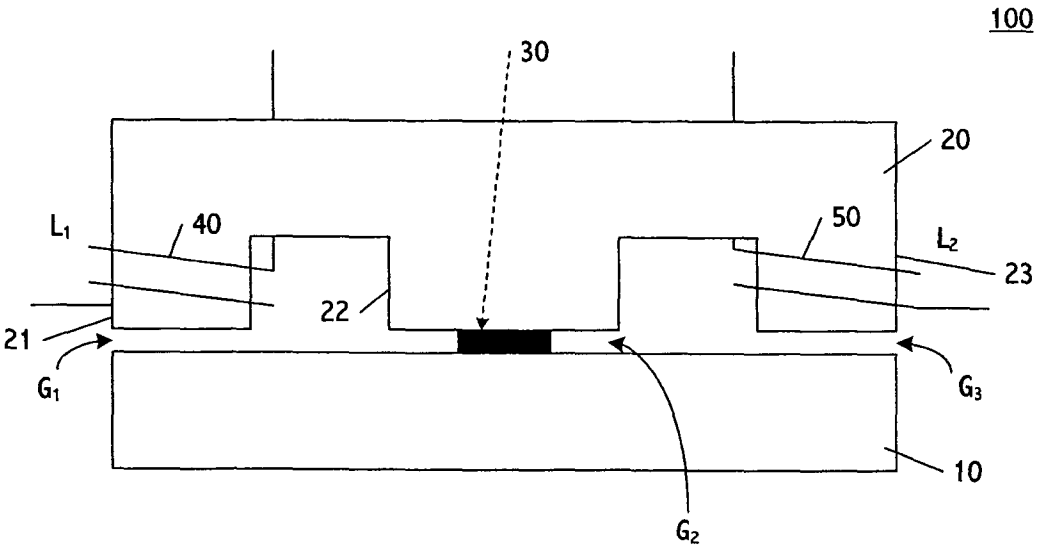
FIG. 1 shows an inductor that switches between coupled and decoupled states.

FIG. 1 shows a first embodiment of an inductor 100 that switches between coupled and decoupled states. The inductor includes a first core 10, a second core 20, and a filler 30. The first and second cores may have different shapes and are made from the same or different materials. Examples of these materials include ferromagnetic metals (e.g., iron) or alloys or any other material capable of supporting the formation of a magnetic field. The first and second cores may be integrally formed. Alternatively, one or more of the cores may have a laminated structure formed from combined plates or other structures.

The first core 10 may be configured to have multiple sections in different arrangements. In this embodiment, the first core has substantially a bar, linear or I-shaped configuration and the second core 20 has multiple sections, at least some of which extend towards the first core. In the example shown in FIG. 1, the second core has three sections extending toward the first core, namely a first section 21, a second section 22, and a third section 23 arranged in sequence and extending from a main section 24. Arranged in this manner, the second core substantially is in the shape of an E. Hence, the combination of the first and second cores may be considered to have an "EI" configuration.

As shown in FIG. 1, each section of the second core is spaced from the first core. The spacing between the first section and first core includes a gap G1, the spacing between the second section and the first core includes a gap G2, and the spacing between the third section and the first core includes a gap G3. The gaps affect the flow of magnetic flux and thus the inductance values of the different core sections. In one embodiment, all three gaps may be substantially the same. In other embodiments, one or more of the gaps may be different depending on the application of the inductor and the magnetic flux to be generated.

In addition to or in lieu of setting the gap spacings, other inductor values may be set to achieve a desired level of performance for the inductor. For example, the number of windings 40 and 50 around the first and third sections, respectively, of the second core may be different, and/or the type of conductors used to form the windings may be different. Based on the number of windings, the type of conductors used for the windings, and/or gap spacings, different inductances may be generated in association with the first and third sections of the second core. The inductance for the first section is shown as L1 and the inductance for the second section is shown as L2.

The filler 30 is located the first core and the second section of the second core. In accordance with one embodiment, the second core 22 does not have any windings. This may help assist the inductor to switch between coupled and decoupled states in a manner to be described in greater detail below. To facilitate switching between these states, the filler is made from a material having a predetermined magnetic permeability.

In accordance with one embodiment, the filler is made from a material having a magnetic permeability which lies in a predetermined range. This material may be the same or different from the material from which one of the first or second cores are made from. One example of the core material is ferrite alloy.

In other applications, the filler material may lie in a different range of magnetic permeability depending, for example, on the gap spacing and materials from which the core is made. In the embodiment of FIG. 1, the areas between the sections of the second core may be filled with a material having a low magnetic permeability or no magnetic permeability, or these areas may be air gaps. Also, gaps G1 and G3 may be air gaps or one or more of these gaps may be filled with a material of no or low magnetic permeability, depending on the given application.

The filler between first core and the second section of the second core may also have varying dimensions. In one embodiment, the filler contacts the first core and second sections on respective upper and lower surfaces. Alternatively, only one of the first core and second section may contact the filler, leaving a smaller spacing between the filler and the other of the first core or second section.

Also, in terms of lateral dimensions, the width of the filler is shown in FIG. 1 to be less than a width of the second section of the second core. However, in other embodiments, the filler may have a different width and even one that is substantially equal to or greater than the width of the second section.

The inclusion of the filler allows the inductor to switch between coupled and decoupled states. This switching is made possible based on changes in the saturation level of the filler material. More specifically, in a magnetic circuit, magnetic flux will follow of the path of least magnetic reluctance. (Magnetic reluctance, therefore, may be considered to be analogous to resistance in an electric circuit). The saturation level of filler 30 in the gap of FIG. 1 serves to control the path of travel of the magnetic flux. More specifically, in the inductor of FIG. 1, changes in the saturation level of the filler changes the magnetic reluctance paths generated from the windings around respective ones of the core sections. This, in turn causes the inductor to switch between coupled and decoupled states.

In accordance with one embodiment, the saturation level of the filler material (and thus state-switching) may be determined by the type of material chosen for the filler and the size of the load current. Based on the magnetic permeability of the filler material, the load current flowing through the windings will cause the core windings to have different inductances and will cause a substantial portion of the magnetic flux lines from the core windings to follow different paths.

Figure 2A:
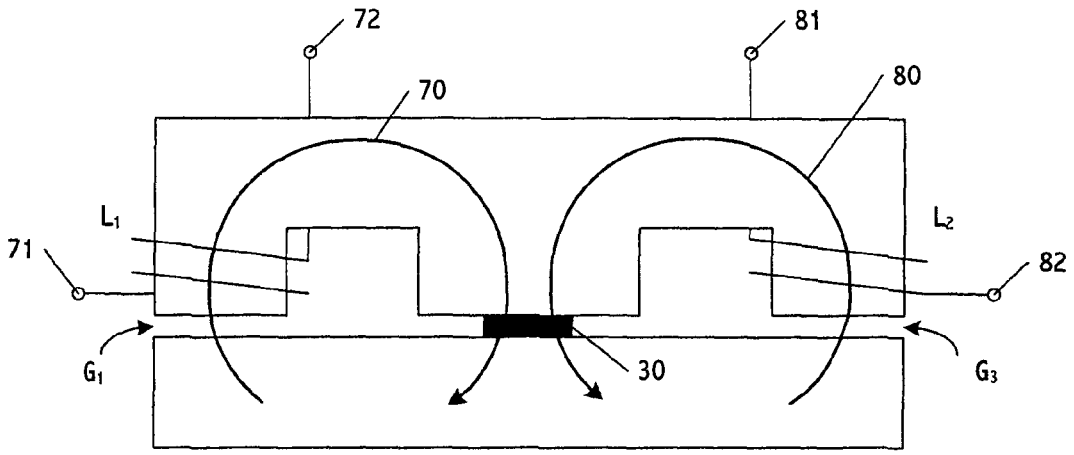
FIG. 2(*a*) shows an example of magnetic flux generated when the inductor is operating in a decoupled state, and FIG. 2(*b*) shows an equivalent diagram of the inductor operating with buck regulator in this state.
Figure 2B:
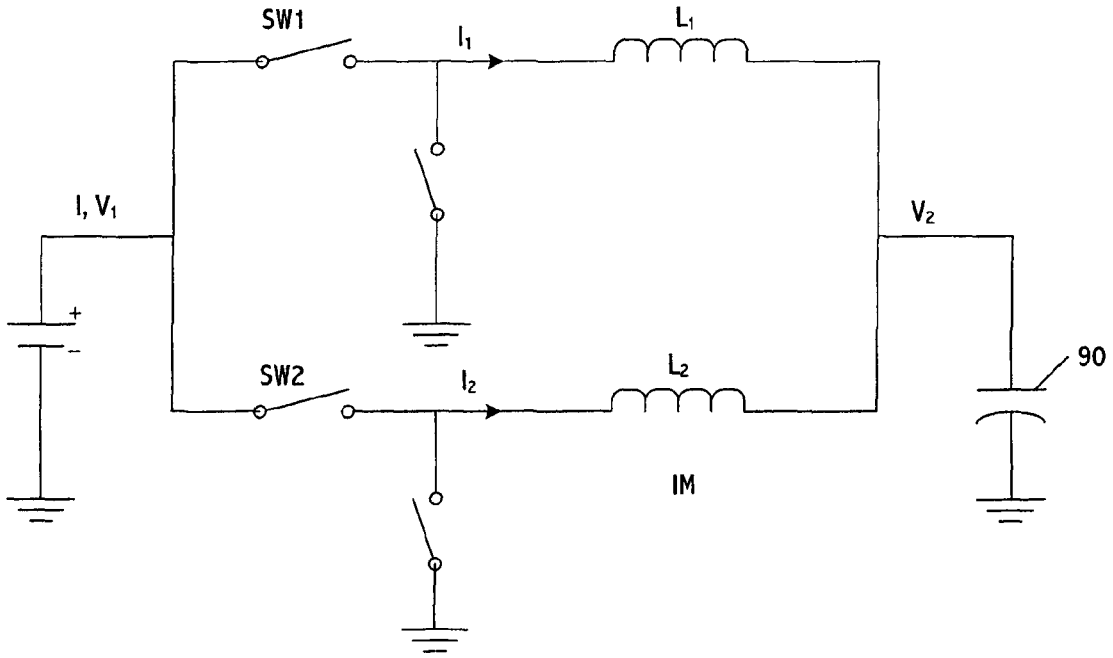

FIG. 2(*a*) shows an example of magnetic flux patterns generated when the inductor is operating a decoupled state. In this state, the windings 40 around core section 21 operate as a first inductor and the windings 50 around core section 23 operate as a second inductor. Because the first and second inductors operate separately, the inductor 100 is considered to be in a decoupled state.

This decoupled state occurs automatically based on a size of the load current flowing through the inductor in relation to the magnetic permeability of the filler material. In this example, when the load current (IL) is less that a predetermined threshold value (ITH), the filler material is in a magnetically unsaturated state. As a result, the magnetic flux 70 from the first inductor flows along a low magnetic reluctance path that passes through second core section 22 and filler 30, and magnetic flux 80 from the second inductor flows along a low magnetic reluctance path that also passes through the second core section and filler.

Also, as shown, the magnetic flux from the inductors may flow in different directions. This may be accomplished by sending current through the inductors in opposing directions. For example, current may be sent into inductor L1 through terminal 71 and current may exit this inductor through terminal 72. Conversely, current may be sent into inductor L2 through terminal 81 and current may exit this inductor through terminal 82.

FIG. 2(*b*) is an equivalent diagram of the inductor corresponding to the state shown in FIG. 2(*a*). In this diagram, because of the low inductance paths through the filler, the first and second inductors L1 and L2 operate separately based on currents I1 and I2 respectively flowing through their windings. In accordance with one embodiment, the sum of currents I1 and I2 may be considered to correspond to the load current.

Also, in FIG. 2(*b*), switches SW1 and SW2 may be included for selectively switching the inductors to a circuit including the load to be driven. The switches may be alternately closed to couple the same or different inductances of the inductors to a load, illustratively shown by capacitor 90, or only either of the switches may be closed or both switches may be simultaneously closed depending on the requirements of the load.

Figure 3A:
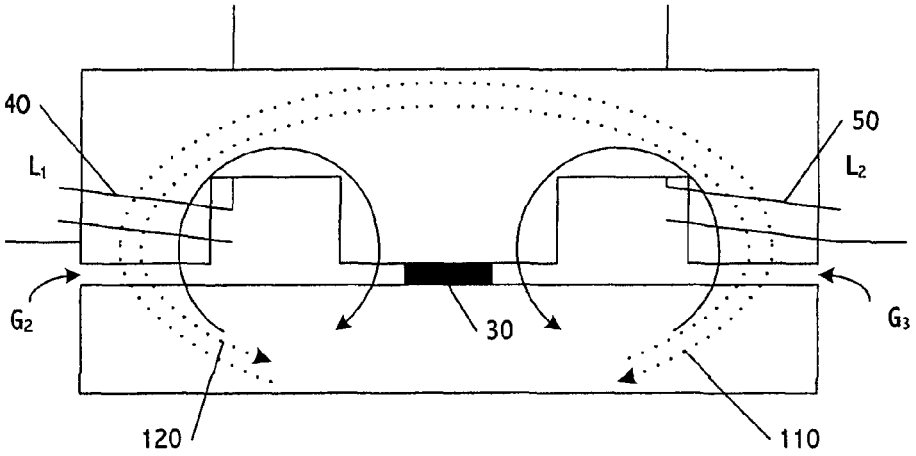
FIG. 3(*a*) shows an example of magnetic flux generated when the inductor is operating in a coupled state, and FIG. 3(*b*) shows an equivalent diagram of the inductor operating with buck regulator in this state.
Figure 3B:
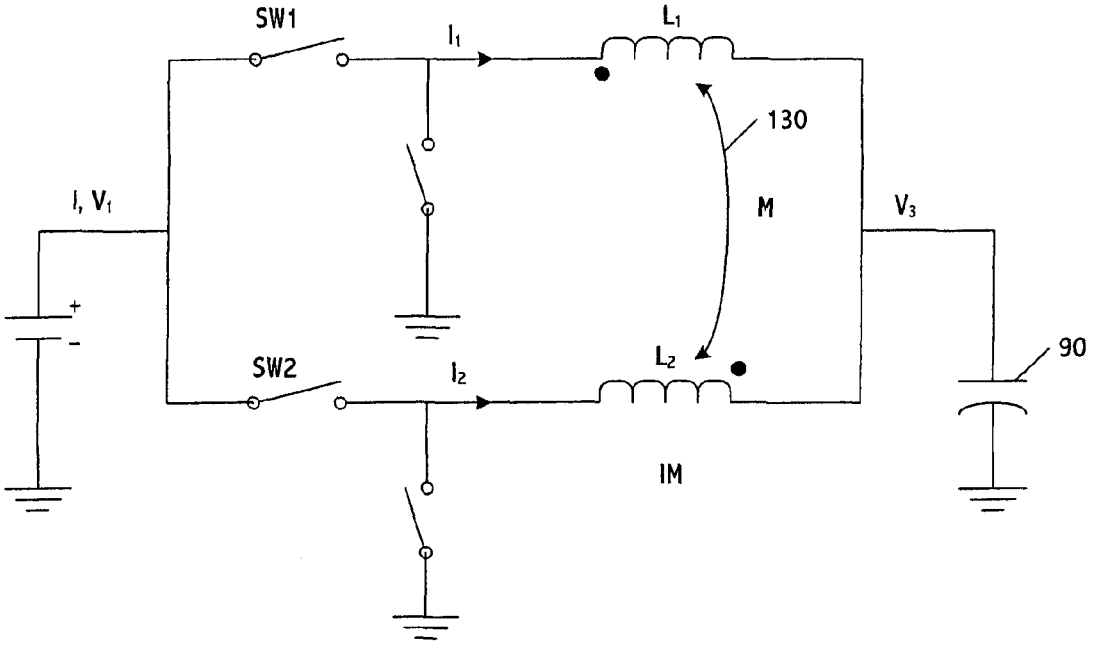

FIG. 3(*a*) shows an example of magnetic flux generated when the inductor is operating in a coupled state. In this state, the windings 40 around core section 21 and the windings 50 around core section 23 produce magnetic flux which is added together to form the flux (and thus the inductance) of a coupled inductor.

Figure 4:
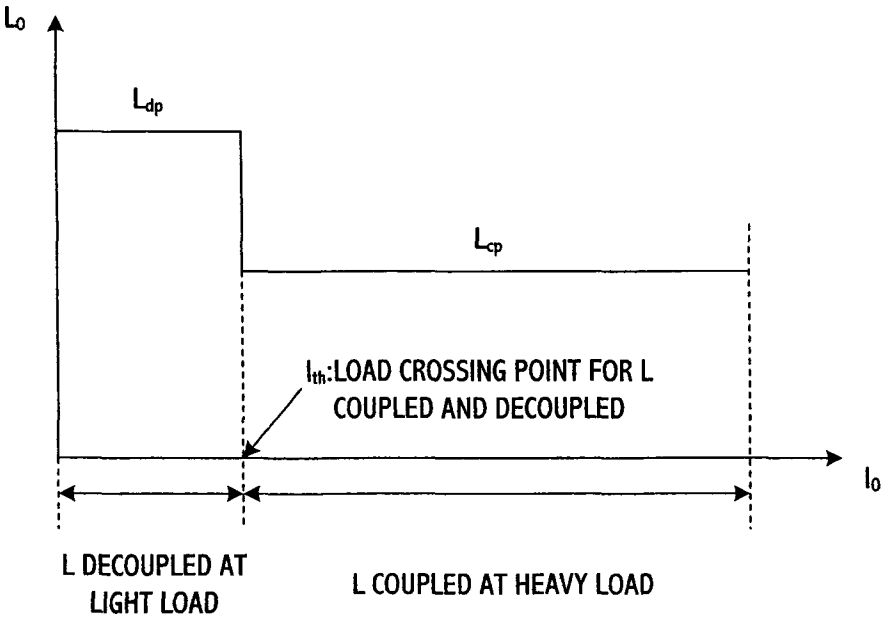
FIG. 4 shows a relationship between inductance and load current for one embodiment.

If the flux from the windings flows in the same direction, the net flux (and thus inductance) in the coupled state will be greater than the individual inductances of the windings, e.g., $L_{Coupled\ State}$=L1−L2 or $L_{Coupled\ State}$=L2+L1, or even $L_{Coupled\ State}$=L1+L2 in certain circumstances. Conversely, if the flux from the windings flows in different directions, some of the flux from one winding will cancel the flux from the other winding, producing a net flux (and inductance) in the coupled state that is less than one or both of the windings taken individually. An example of this latter case is shown in FIG. 4 to be discussed in greater detail below.

This coupled state occurs automatically based on a size of the load current in relation to the magnetic permeability of the filler material. In this example, when the load current (IL) is greater than the predetermined threshold value (ITH), the filler material is magnetically saturated. As a result, the filler material functions essentially as a non-magnetic material (e.g., one that is not magnetically permeable such as air) and the magnetic flux from the first and second inductors will flow through the second core section 22 but a substantial amount of this flux will not flow through filler 30.

In operation, the current may be switched into both or only one of the windings 40 or 50. If current is only switched into one of windings 40 or 50, the direction of flow of the magnetic flux of the inductor 100 in the coupled state is determined by the inductor winding which receives the input current. For example, if winding 40 receives the input load current, then the magnetic flux of inductor 100 in the coupled state traverses a clockwise path 110. If winding 50 receives the input load current, then the magnetic flux of inductor 100 in the coupled state traverses counterclockwise path 120. If current is switched into both windings 40 and 50, the direction of flow of the magnetic flux of the inductor 100 in the coupled state may be determined by a sum of the flux for the individual windings.

FIG. 3(*b*) shows an equivalent diagram of the inductor in the coupled state corresponding to FIG. 3(*a*). In this diagram, because of the filler is saturated, the inductance path through the filler is too high to pass any substantial amount of magnetic flux. Consequently, as shown by arrow 130, the inductors L1 and L2 operate in a coupled state having a magnetic flux direction and coupled inductance value based on which switch SW1 or SW2 is closed. In FIG. 3(*b*), the letter M indicates the formation of a mutual inductance between the core windings, e.g., provides an indication of the extent of coupling between the windings.

Also, in FIGS. 2(*b*) and 3(*b*), the dots adjacent the windings denote the voltage polarity with respect to the windings. For example, when current enters the dot corresponding to the windings of L1, energy is induced in the windings of L2 and current is output along the circuit path coupled to the dot of this second winding.

In accordance with one embodiment, an inductor 100 may be configured according to the following illustrative materials and values. Different materials and/or values may be used in other embodiments.

Material for Core 10: Ferrite Alloy
Material for Core 20: Ferrite Alloy
Material for Filler 30: Ferrite Alloy
Magnetic Permeability Value for Filler 30: 3000 $\mu_0$
Width of Core 10: 10 mm
Width of Core 20: 10 mm
Gap (G2) Spacing: 0.32 mm
Threshold current value ($I_{TH}$): 10 A
Range of Load Current (I): 42
Inductance Value of Separate Inductors in Decoupled State:
$L_1$=371 nH
$L_2$=370 nH
Inductance Value of Inductor in Coupled State: 298 nH FIG. 4 shows a diagram showing a relationship between the inductance of inductor 100 and load current for the case where the inductor operates in a non-linear manner. In this diagram, the load current may fall into one of two ranges. The first range is a light load current range, where load current I0<ITH. In this range, the inductor operates in a decoupled state where each core winding exhibits an inductance of Ldp; that is, L1=L2 =Ldp.

The second range is a heavy load current range, where load current I0>ITH. In this range, the inductor operates in a coupled state in which inductor 100 exhibits an inductance of Lcp. In this example, the coupled-state inductance Lcp is less than the inductance of the individual coil windings Ldcp. This may be attributed to differences in the polarity of the windings 40 and 50 and/or the number of windings around core sections 21 and 23. Thus, in this example, the magnetic flux generated by one winding may partially cancel the magnetic flux of the other winding, to yield a net mutual inductance, Lcp.

In other embodiments, the polarity of the windings, number of windings, input terminals to the windings, and/or other factors may be varied to form a different mutual inductance. For example, the magnetic flux from the windings may be additive such that Lcp>Ldcp.

Figure 5:
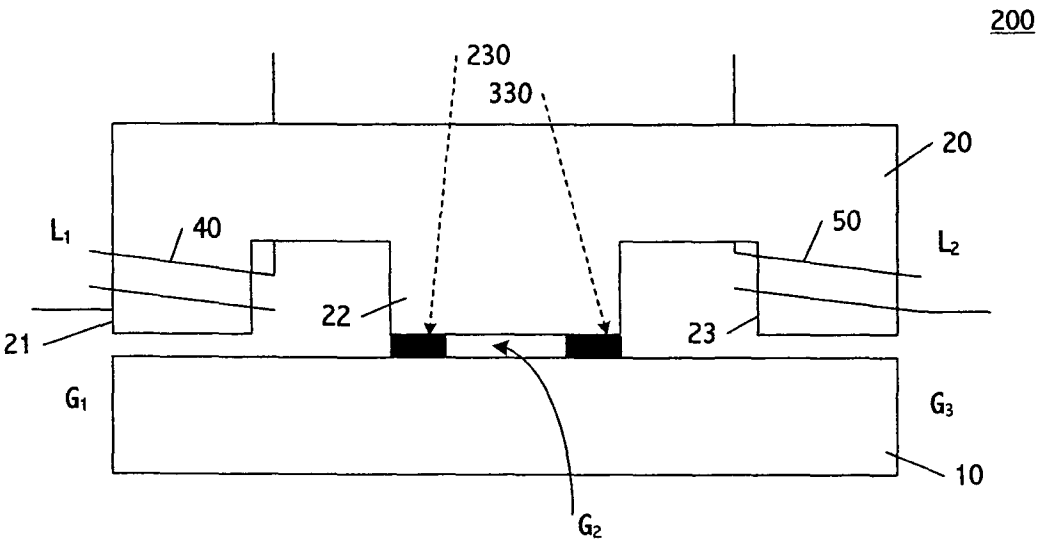
FIG. 5 shows another inductor switching between coupled and decoupled states.

FIG. 5 shows an inductor 200 in accordance with another embodiment. This inductor is similar to the inductor in FIG. 1 except that two fillers 230 and 330 are in gap G2 between cores 10 and 20. These fillers may be made from any of the materials used for filler 30 and therefore may demonstrate the same or similar magnetic permeability and, thus, the same or similar reluctance of gap G2. Alternatively, the fillers may be made from different materials and/or ones with different magnetic permeabilities.

In this embodiment, the fillers 230 and 330 are shown to have a predetermined spacing and serve to affect the operational state of the inductor. When the load current is less than the threshold current value (I<ITH), the magnetic flux produced by windings 40 and 50 pass through core section 22 and fillers 230 and 330, as these fillers are not magnetically saturated. As a result, the windings function as separate inductors in a decoupled state.

In accordance with one embodiment, the windings may operate in a decoupled state when the magnetic flux level of only one of the first or second fillers is unsaturated. Under these conditions, the other filler may be magnetically saturated or unsaturated. Alternatively, the windings may operate in the decoupled state when the magnetic flux levels of both fillers are unsaturated. These different modes of operation may depend, for example, on the amount of current passing through one or more of the windings, the materials selected for the fillers, and/or the spacing between the fillers.

When the load current is greater than the threshold current value (I>ITH), both fillers are magnetically saturated. As a result, flux from the windings passes through second core section 22, but a substantial amount of flux does not pass through the fillers. As a result, the inductor 200 operates in a coupled state, producing a mutual inductance where Lcp may be greater or less than Ldcp depending, for example, on the polarity and/or number of windings around each core section.

In the inductors of FIGS. 1 and 5, core 20 has three sections. In other embodiments, this core may have more than three sections with a non-wound intervening core section between adjacent wound core pairs. In this case, an inductor may be formed to have greater mutual inductance in the coupled state than that formed by the ones in FIGS. 1 and 5. Moreover, these pairs may be selectively switched in order to produce the inductance required for a given load application.

In another embodiment, a voltage regulator may be formed using the inductor in FIG. 1 or 5. An example of such a voltage regulator is shown in FIGS. 2(*b*) and 3(*b*), where the included inductor is operating in decoupled and coupled states respectively. In FIG. 2(*b*), an input voltage V1 is converted into an output voltage V2 as a result of the inductor operating in the decoupled state. In FIG. 3(*b*), the input voltage is converted into an output voltage V3 as a result of the inductor operating in the coupled state.

Figure 6:
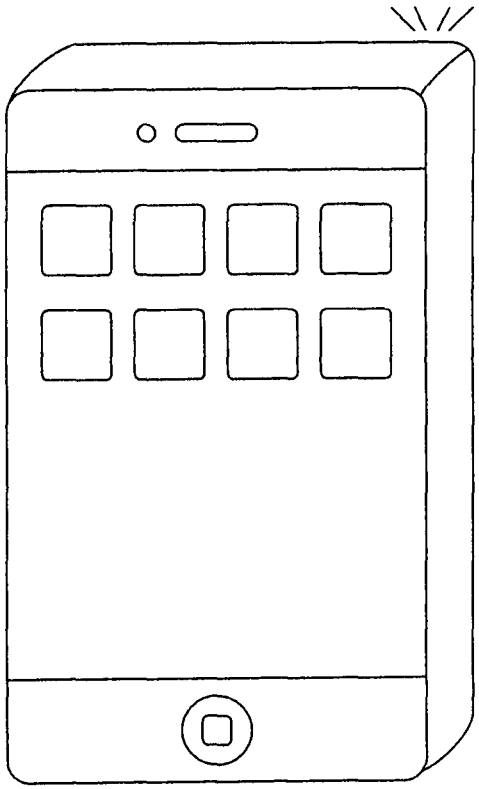
FIG. 6 shows a terminal which may include an inductor as described herein.

FIG. 6 shows an example of an electronic device which may include a voltage regulator in accordance with the aforementioned embodiment. In this example, the electronic device is a mobile terminal which, for example, may be a smart phone, pod-type device, notebook or laptop computer, or another type of data terminal. The device is not required to be portable.

Figure 7:
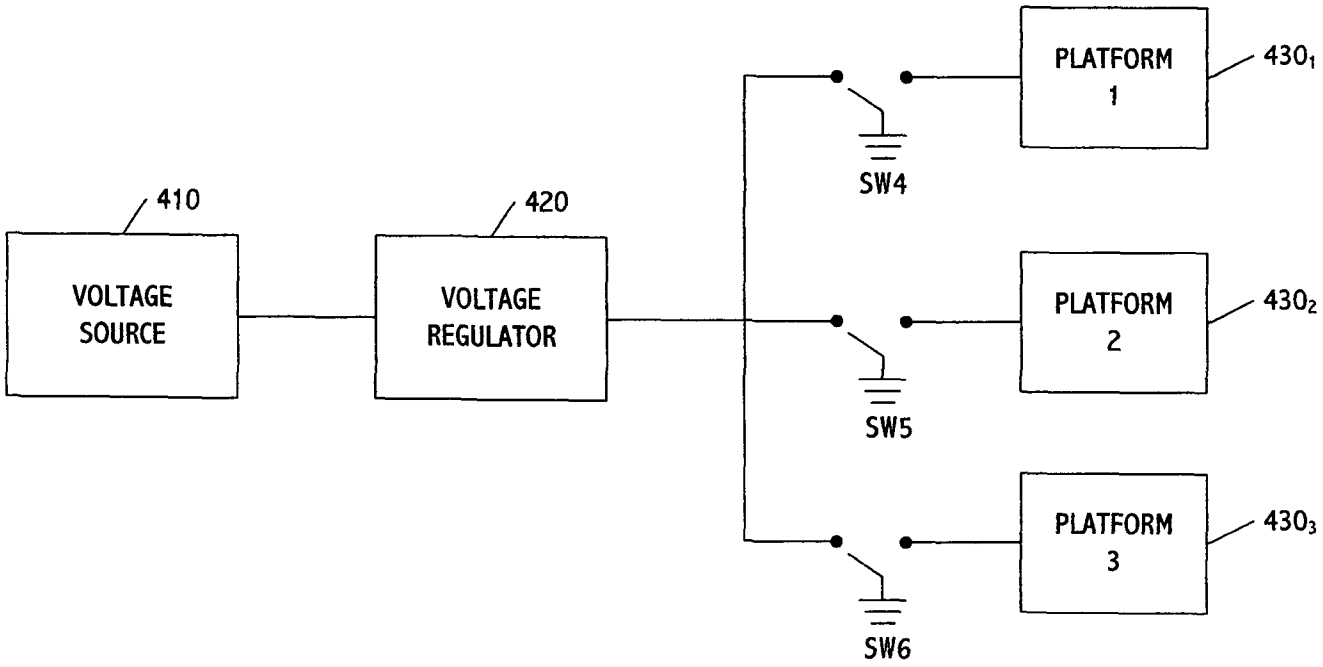
FIG. 7 shows an example of a circuit for generating voltage using a voltage regulator that incorporates the inductor for powering different platforms of a terminal.

FIG. 7 shows one embodiment of an internal configuration of the device of FIG. 6. In this embodiment, the device includes a voltage source 410, a voltage regulator 420, and one or more platforms 4301, 4302, and 4303, which may have different voltage requirements to support different functions or operations in the terminal. For example, when the electronic device is a mobile terminal, one platform may operate the communication circuits of the terminal, another platform may operate a media player of the terminal, and the third platform may operate a camera function.

The coupling between the voltage regulator and platforms may be selectively switched to change the current passing through the inductor of the regulator. The inductor may be one in accordance with any of the aforementioned embodiments. If the voltage regulator has an inductor which corresponds to the one shown in FIG. 2(*a*), then L1 may be switched by switch SW4 to generate a first voltage to platform 4301 and L2 may be switched by SW5 to generate a second voltage to platform 4302. Both inductors may be in the decoupled state at this time, i.e., the magnetic flux through the at least one filler is at an unsaturated level.

In the coupled state, a mutual inductance formed by L1 and L2 may be used to generate a third voltage to platform 4303 when switch SW6 closes. The magnetic flux through the at least one filler may be at a saturated level at this time. Alternatively in the coupled state, all the fillers may be saturated. If one of the fillers is not saturated, the flux of L1 and L2 may not pass across each other, but across the unsaturated filler at center section.

In accordance with one embodiment, V1≠V2≠V3. As in the previously embodiments, the amount of magnetic flux through the filler may be controlled, for example, based on the current through one or more of the windings, the magnetic permeability of the filler, and the spacing between the fillers when a multi-filler embodiment of the inductor is used.

In accordance with one embodiment that has a multiple-filler design, the saturation levels of the fillers may be the same or different. If different, the difference may be based, for example, on the use of different materials to form the fillers, different dimensions, and/or other factors.

Figures 8A, 8B, 8C:
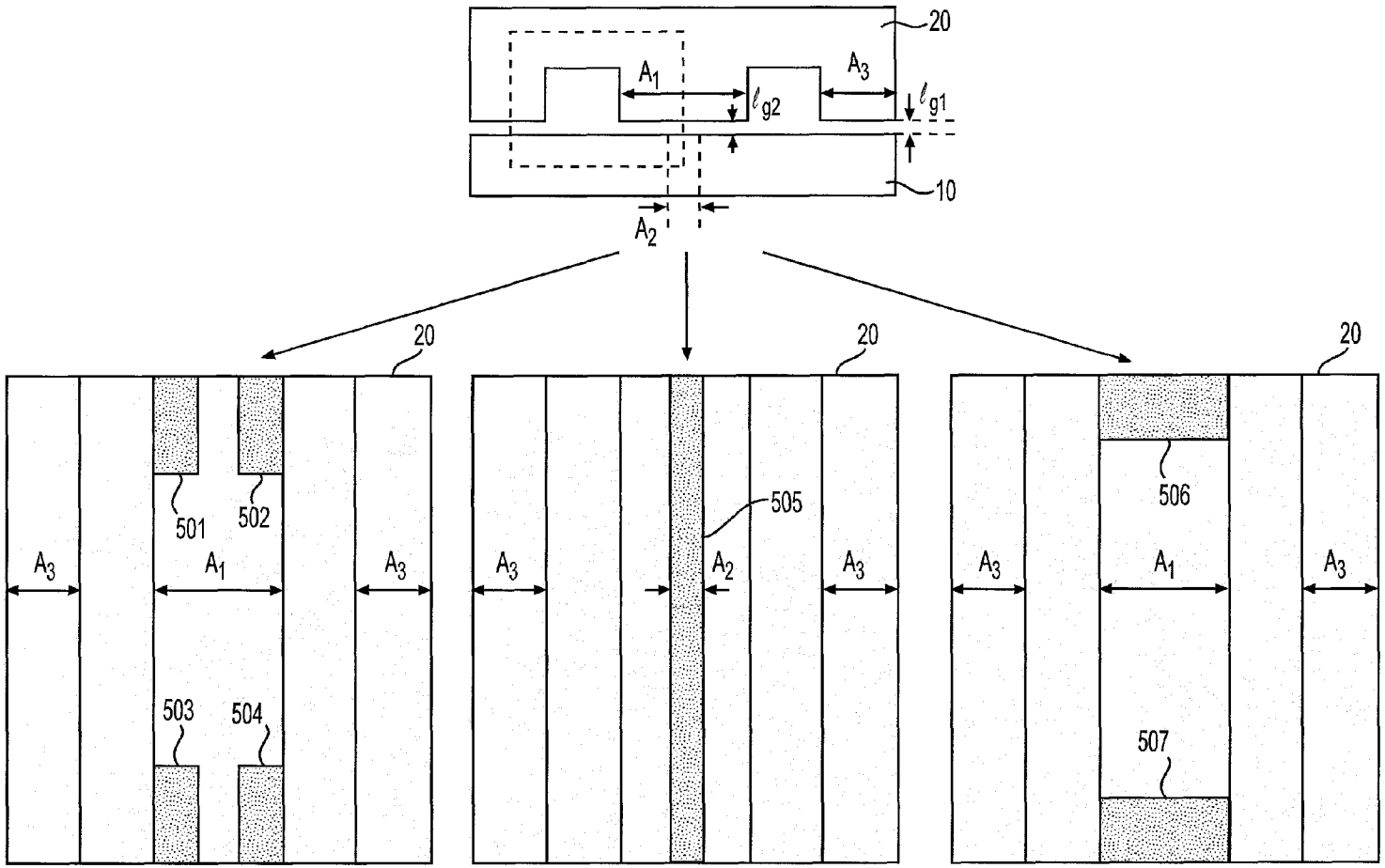
FIGS. 8(*a*)-8(*c*) show additional filler arrangements between the first and second cores of an inductor.

FIGS. 8(*a*)-8(*c*) shows additional arrangements that include one or more fillers between the first and second cores. In these figures, a bottom view of the second core is shown in relation to a cross-sectional view of the inductor. The width (A3) of the first and third sections of the second core is less than the width (A1) of the second section of the second core. The dotted line represents magnetic flux passing through at least one filler.

FIG. 8(*a*) shows an arrangement where four fillers are used. In this embodiment, a first pair of fillers 501 and 502 are located at one sides edge of the second section of the second core and a second pair of fillers 503 and 504 are located at an opposing side edge of the second section of the second core. The fillers in each pair may be spaced by substantially the same distances. Alternatively, the spacing between filler 501 and 503 may be different from the spacing between fillers 502 and 504, and/or the spacing between fillers 501 and 502 may be different from the spacing between fillers 503 and 504.

FIG. 8(*b*) shows an arrangement is shown where a single filler 505 is included having a length that is essentially equal to a length of the second section of the second core. The width of filler 505 is shown as A2, which is smaller than the width A1 of the second section of the second core.

FIG. 8(*c*) shows an arrangement having two fillers 506 and 507 located at respective side edges of the second section of the second core. The fillers may have substantially the same width and/or length. In different embodiments, however, the widths may be different and/or the spacing may be less, so that one or both of the fillers are not located at the side edges of the second section.

Any reference in this specification to an "embodiment" means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments. The feature of any one embodiment may be combined with the features of one or more of the other embodiments to form new embodiments.

Furthermore, for ease of understanding, certain functional blocks may have been delineated as separate blocks; however, these separately delineated blocks should not necessarily be construed as being in the order in which they are discussed or otherwise presented herein. For example, some blocks may be able to be performed in an alternative ordering, simultaneously, etc.

Although the present invention has been described herein with reference to a number of illustrative embodiments, it should be understood that numerous other modifications and embodiments can be devised by those skilled in the art that will fall within the spirit and scope of the principles of this invention. More particularly, reasonable variations and modifications are possible in the component parts and/or arrangements of the subject combination arrangement within the scope of the foregoing disclosure, the drawings and the appended claims without departing from the spirit of the invention. In addition to variations and modifications in the component parts and/or arrangements, alternative uses will also be apparent to those skilled in the art.

I claim:

1. An apparatus comprising:

a first core;

a second core adjacent the first core and having:

a) a main section;

b) a first section that extends from the main section, and a first winding is wound around the first section that extends from the main section, c) a second section that extends from the main section and is spaced from the first core, d) a third section that extends from the main section, and a second winding is wound around the third section that extends from the main section, and a filler having a magnetic permeability, wherein the second section is between the first and third sections of the second core and wherein the filler is located in a gap between the first core and the second section of the second core.

2. The apparatus of claim 1, wherein:

a first inductor is formed from the first winding and the first section, a second inductor is formed from the second winding and the third section, and a state of operation of the apparatus is to change based on a level of magnetic flux that is to pass through the filler.

3. The apparatus of claim 2, wherein the apparatus to operate in:

a first state when a level of magnetic flux that is to pass through the filler is at an unsaturated level, and a second state when the level of magnetic flux that is to pass through the filler is at a saturated level.

4. The apparatus of claim 3, wherein the first and second inductors are to operate as decoupled inductors in the first state and are to operate as a coupled inductor in the second state.

5. The apparatus of claim 4, wherein the level of magnetic flux that is to pass through the filler is based on an amount of current to be input into at least one of the first winding or the second winding.

6. The apparatus of claim 5, wherein:

the first and second inductors are to operate as decoupled inductors when the current lies in a first range, and the first and second inductors are to operate as a coupled inductor when the current lies in a second range.

7. The apparatus of claim 6, wherein the second range is greater than the first range.

8. The apparatus of claim 6, wherein an inductance of the coupled inductor is to be lower than an inductance of each of the first and second inductors operating as decoupled inductors.

9. The apparatus of claim 1, wherein the magnetic permeability of the filler is different from a magnetic permeability of the first core or the second core.

10. The apparatus of claim 1, wherein the magnetic permeability of the filler is substantially equal to a magnetic permeability of the first core or the second core.

11. The apparatus of claim 1, wherein the filler and the second core are made from different materials.

12. The apparatus of claim 1, wherein magnetic flux to be generated from the first winding and the second winding is to pass through the second section of the second core and the filler.

13. The apparatus of claim 1, wherein the filler contacts one of the first core or the second section of the second core.

14. The apparatus of claim 1, wherein the filler contacts the first core and the second section of the second core.

15. An apparatus comprising:

a first core;

a second core adjacent the first core and having:

a) a main section;

b) a first section that extends from the main section, and a first winding is around the first section that extends from the main section, c) a second section that extends from the main section and is spaces from the first core, d) a third section that extends from the main section, and a second winding is around the third section that extends from the main section, a first filler located between the first and second cores, and a second filler located between the first and second cores, wherein the second section is between the first and third sections of the second core, wherein the first filler is spaced from the second filler, and wherein the first and second fillers are located in a gap between the first core and the second section of the second core.

16. The apparatus of claim 15, wherein the first filler and the second filler are made from magnetically permeable material.

17. The apparatus of claim 16, wherein the first filler and the second filler have magnetic permeabilities that are substantially equal.

18. The apparatus of claim 16, wherein the first filler and the second filler have magnetic permeabilities that are different.

19. The apparatus of claim 15, wherein:

a first inductor is formed from the first winding and the first section, a second inductor is formed from the second winding and the third section, and a state of operation of the apparatus is to change based on levels of magnetic flux that are to pass through the first and second fillers.

20. The apparatus of claim 19, wherein the apparatus to operate in:

a first state when the magnetic flux level of at least one of the first or second fillers is at an unsaturated level, and a second state when the magnetic flux levels of the first and second fillers are at saturated levels.

21. The apparatus of claim 20, wherein the apparatus is to operate in the first state when the magnetic flux level that is to pass through the first and second fillers are at unsaturated levels.

22. The apparatus of claim 20, wherein the first and second inductors are to operate as decoupled inductors in the first state and operate as a coupled inductor in the second state.

23. The apparatus of claim 22, wherein the magnetic flux levels that are to pass through the first and second fillers are based on an amount of current to be input into the first or second windings.

24. The apparatus of claim 23, wherein:

the first and second inductors are to operate as decoupled inductors when the current lies in a first range, and the first and second inductors are to operate as a coupled inductor when the current lies in a second range.

25. An apparatus comprising:

a first platform to operate at a first voltage;

a second platform to operate at a second voltage; and a voltage regulator with an inductor to provide the first and second voltages, wherein:

the inductor includes a first core, a second core with a main section, a first section having a first winding, a second section having a second winding, and a third section between the first and second sections, the first section extending from the main section, the second section extending from the main section and the third section extending from the main section, and at least one filler in a gap between the first core and the third section, the at least one filler is magnetically permeable, and the inductor is to control output of the first voltage when magnetic flux that is to pass through the at least one filler is at a first level and is to control output of the second voltage when magnetic flux that is to pass through the at least one filler is at a second level.

26. The apparatus of claim 25, wherein the first level corresponds to an unsaturated level of magnetic flux that is to pass through the at least one filler and wherein the second level corresponds to a saturated level of magnetic flux that is to pass through the at least one filler.

27. The apparatus of claim 26, wherein:

the first winding and the first section form a first inductor section, the second winding and the second section form a second inductor section, and the first and second inductor sections are to operate in a decoupled state when the magnetic flux that is to pass through the at least one filler is at the first level and are to operate in a coupled state when the magnetic flux that is to pass through the at least one filler is at the second level.

28. The apparatus of claim 27, wherein:

the magnetic flux that is to pass through the at least one filler is to be at the first level when current through at least one of the first winding or the second winding lies in a first range, and the magnetic flux that is to pass through the at least one filler is to be at the second level when current through at least one of the first winding or the second winding lies in a second range.

29. The apparatus of claim 28, wherein the second range is greater than the first range.

30. The apparatus of claim 27, wherein the magnetic flux to be generated from the first and second windings is to pass through the third section of the second core and the at least one filler.

* * * * *